US006175637B1

(12) United States Patent
Fujihira et al.

(10) Patent No.: US 6,175,637 B1
(45) Date of Patent: Jan. 16, 2001

(54) ACOUSTIC TRANSDUCER

(75) Inventors: Masao Fujihira, Kanagawa; Makoto Yamagishi, Tokyo; Jun Kishigami, Saitama; Takahiro Muraguchi, Tokyo; Kenji Tokushige, Tokyo; Ikuo Shinohara, Tokyo, all of (JP)

(73) Assignee: Sony Corporation, Tokyo (JP)

( * ) Notice: Under 35 U.S.C. 154(b), the term of this patent shall be extended for 0 days.

(21) Appl. No.: 09/049,067

(22) Filed: Mar. 27, 1998

(30) Foreign Application Priority Data

Apr. 1, 1997 (JP) ..... 9-082703

(51) Int. Cl.[7] ..... H04R 25/00

(52) U.S. Cl. ..... 381/412; 381/401; 381/405; 381/410

(58) Field of Search ..... 381/412, 413, 381/421, 396, 398, 400, 401, 409, 410, 185, 406, 424, 420, 422

(56) References Cited

U.S. PATENT DOCUMENTS 4,720,868 * 1/1988 Hirano ..... 381/182
5,647,014 * 7/1997 Geisenberger ..... 381/194
5,909,496 * 6/1999 Kishigami et al. ..... 381/111
5,909,499 * 6/1999 Tanabe ..... 381/419
5,923,769 * 7/1999 Fushimi ..... 381/338
6,035,052 * 3/2000 Fujihira et al. ..... 381/401

* cited by examiner

*Primary Examiner*—Curtis A. Kuntz
*Assistant Examiner*—Dionne N. Harvey
(74) *Attorney, Agent, or Firm*—Jay H. Maioli

(57) ABSTRACT

An electromagnetic induction type acoustic transducer apparatus including a magnetic gap formed between a plate and a pole piece serving as assemblies of a magnetic circuit, a conductive ring attached to a diaphragm, the diaphragm interposed within the magnetic gap for generating sounds when it is vibrated, and a flat coil disposed in the plate or the pole piece at the position opposing the magnetic gap and of which winding is increased from the vibration direction of the diaphragm to the direction perpendicular to the vibration direction of the diaphragm, wherein a width of the magnetic gap can be reduced.

5 Claims, 15 Drawing Sheets

FIG. 12

| CURRENT | MSB | 2 SB | 3 SB | 4 SB | 5 SB | 6 SB | 7 SB | 8 SB | 9 SB | 10 SB | 11 SB | 12 SB | 13 SB | 14 SB | 15 SB | LSB |
|---|---|---|---|---|---|---|---|---|---|---|---|---|---|---|---|---|
| + | 0 | 1 | 1 | 1 | 1 | 1 | 1 | 1 | 1 | 1 | 1 | 1 | 1 | 1 | 1 | 1 |
| | 0 | 1 | 1 | 1 | 1 | 1 | 1 | 1 | 1 | 1 | 1 | 1 | 1 | 1 | 1 | 0 |
| | 0 | 1 | 1 | 1 | 1 | 1 | 1 | 1 | 1 | 1 | 1 | 1 | 1 | 1 | 0 | 1 |
| | 0 | 1 | 1 | 1 | 1 | 1 | 1 | 1 | 1 | 1 | 1 | 1 | 1 | 1 | 0 | 0 |
| | | | | | | | | | | | | | | | | |
| | 0 | 0 | 0 | 0 | 0 | 0 | 0 | 0 | 0 | 0 | 0 | 0 | 0 | 0 | 1 | 1 |
| | 0 | 0 | 0 | 0 | 0 | 0 | 0 | 0 | 0 | 0 | 0 | 0 | 0 | 0 | 1 | 0 |
| | 0 | 0 | 0 | 0 | 0 | 0 | 0 | 0 | 0 | 0 | 0 | 0 | 0 | 0 | 0 | 1 |
| 0 | 0 | 0 | 0 | 0 | 0 | 0 | 0 | 0 | 0 | 0 | 0 | 0 | 0 | 0 | 0 | 0 |
| | 1 | 1 | 1 | 1 | 1 | 1 | 1 | 1 | 1 | 1 | 1 | 1 | 1 | 1 | 1 | 0 |
| | 1 | 1 | 1 | 1 | 1 | 1 | 1 | 1 | 1 | 1 | 1 | 1 | 1 | 1 | 0 | 0 |
| | 1 | 1 | 1 | 1 | 1 | 1 | 1 | 1 | 1 | 1 | 1 | 1 | 1 | 1 | 0 | 0 |
| | | | | | | | | | | | | | | | | |
| | 1 | 0 | 0 | 0 | 0 | 0 | 0 | 0 | 0 | 0 | 0 | 0 | 0 | 0 | 1 | 1 |
| | 1 | 0 | 0 | 0 | 0 | 0 | 0 | 0 | 0 | 0 | 0 | 0 | 0 | 0 | 1 | 0 |
| | 1 | 0 | 0 | 0 | 0 | 0 | 0 | 0 | 0 | 0 | 0 | 0 | 0 | 0 | 0 | 1 |
| − | 1 | 0 | 0 | 0 | 0 | 0 | 0 | 0 | 0 | 0 | 0 | 0 | 0 | 0 | 0 | 0 |
| COIL | | IO | IN | IM | IL | IK | IJ | II | IH | IG | IF | IE | ID | IC | IB | IA |

ACOUSTIC TRANSDUCER

BACKGROUND OF THE INVENTION

1. Field of the Invention

The present invention relates to an acoustic transducer of electromagnetic coupling type (electromagnetic induction type), i.e. a transducer such as a speaker or a headphone for converting an electrical signal into acoustic sounds and a transducer such as a microphone for converting acoustic sounds into an electrical signal.

2. Description of the Related Art

In the case of an external magnet type, for example, an acoustic transducer of an electromagnetic coupling type comprises a magnetic circuit having a magnetic gap formed between a plate and a center pole across a magnet composed of the plate, a yoke with the center pole attached thereto and in which a first coil is fixed to the plate or the center pole within the magnetic gap of the magnetic circuit and an insulated second coil is fixed to a diaphragm in an opposing relation to the first coil within the magnetic gap of the magnetic circuit.

In an acoustic transducer such as a speaker or a headphone, when a first coil is used as a drive coil (primary coil) and a signal current is supplied to this drive coil, a secondary current corresponding to the signal current is induced in a second coil serving as a secondary coil by an electromagnetic coupling. Then, owing to the Fleming's left-hand rule, a drive force corresponding to a signal current is generated in the second coil, and the diaphragm to which the second coil is fixed is vibrated to generate a sound pressure corresponding to the signal current.

FIGS. 14 and 15 show examples of electromagnetic coupling type speakers according to the related art, respectively. FIG. 14 shows the example of the electromagnetic coupling type speaker in which a drive coil is attached to a plate. FIG. 15 shows the example of the electromagnetic coupling type speaker in which a drive coil is attached to a center pole.

Specifically, in the electromagnetic coupling type speaker shown in FIG. 14, a center pole 11 is unitarily formed at the center portion of the upper surface of a flange-like yoke 10. A magnet 20 is attached to the upper surface of the circumferential portion of the yoke 10. An annular plate 30 is attached to the upper surface of the magnet 20. A magnetic circuit 6 is formed so as to have a magnetic gap 5 formed between an outer peripheral surface of a tip end portion of the center pole 11 and an inner peripheral surface of the plate 30, and a drive coil 1 is attached to the inner peripheral end surface of the plate 30.

The yoke 10 has a hole 12 defined at its bottom portion and also has a terminal assembly 4 with an input terminal 3 attached to its lower surface. A lead wire 2 of the drive coil 1 is inserted into the hole 12 and connected to the input terminal 3 by soldering. The lead wire 2 is each attached to the start of the winding and the end of the winding of the drive coil 1, and each connected to a separate input terminal.

A secondary coil 7 is inserted into the magnetic gap 5. The secondary coil 7 is either an insulated cylinder of one turn made of a nonmagnetic conductive material such as aluminum or an insulated winding having a plurality of turns.

A lower portion of a frame 40 is attached to the upper surface of the plate 30. An outer peripheral portion of an upper end of a diaphragm 50 such as a cone is attached through an edge 51 and a gasket 45 to an upper inner peripheral end portion of the frame 40. An outer peripheral portion of a damper 47 is attached to the frame 40, and a lower end portion of the diaphragm 50 and an inner peripheral portion of the damper 47 are attached to the secondary coil 7. A center cap 49 is attached to a lower end portion of the diaphragm 50 or an upper end portion of the secondary coil 7.

In the electromagnetic coupling type speaker shown in FIG. 15, a recess is formed around the outer peripheral surface of the upper end portion of the center pole 11, and the drive coil 1 is attached to the center pole 11 by means of this recess. A rest of elements and parts in FIG. 15 is similar to that of the electromagnetic coupling type speaker shown in FIG. 14.

In the electromagnetic coupling type speaker shown in FIG. 14 or 15, when a signal current is supplied to the drive coil 1, a secondary current corresponding to the signal current is induced in the secondary coil 7 due to an electromagnetic coupling. Then, owing to the Fleming's left-hand rule, a drive force corresponding to the signal current is generated in the secondary coil 7, and the diaphragm 50 with the secondary coil 7 attached thereto is vibrated in the upper and lower direction, thereby resulting in a sound pressure corresponding to the signal current being generated.

However, in the related-art electromagnetic coupling type speaker shown in FIG. 14 or 15, since the drive coil 1 is disposed within the magnetic gap 5 of the magnetic circuit 6, the width (length of the direction perpendicular to the axis of the speaker) of the magnetic gap 5 cannot be reduced by the thickness of the drive coil 1 so that a magnetic force of the magnetic gap 5 is reduced, thereby resulting in a sensitivity of the speaker being lowered. If a large magnet is used as the magnet 20 in order to increase the magnetic force of the magnetic gap 5 and to increase the sensitivity of the speaker, then the speaker becomes large in size and cannot be produced inexpensively.

In addition, if the number of turns of the drive coil increases in order to increase the inductance of the drive coil 1, then the width of the magnetic gap 5 increases so that the sensitivity of the speaker is lowered. Hence, the inductance of the drive coil 1 cannot increase. As a result, an electromagnetic coupling force between the drive coil 1 and the secondary coil 7 is too lowered in a low band range of less than 2 kHz to reproduce low-frequency signals of large amplitude. Hence, the electromagnetic coupling speaker according to the related art can be used only to reproduce high-frequency signals.

Furthermore, while the outer or inner circumferential surface of the drive coil 1 contacts with the plate 30 or the center pole 11, its contact area is small so that heat cannot be radiated from the drive coil 1 instantly. As a consequence, not only a thick wire material cannot be used as the drive coil 1 but also a large current cannot be quickly flowed to the drive coil 1 with the result that an allowable input signal level cannot be increased.

While the case in which the electromagnetic coupling type transducer is applied to the speaker has been described so far, this is also true in other transducer such as the headphone. The transducer such as the microphone has a similar arrangement except only that the input and output are reversed.

SUMMARY OF THE INVENTION

In view of the aforesaid aspect of the present invention, it is an object of the present invention to provide an electromagnetic induction type acoustic transducer apparatus in which a sensitivity can be increased without making the acoustic transducer large in size and without making the acoustic transducer expensive.

It is another object of the present invention to provide an electromagnetic induction type acoustic transducer apparatus in which sounds of low tone can be reproduced or picked up, thereby making it possible to realize a transducer of whole band range type or a transducer specialized in reproducing low-frequency signals of large amplitude.

It is a further object of the present invention to provide an electromagnetic induction type acoustic transducer apparatus in which an allowable input level of a transducer can be increased from a standpoint of a head-radiation of a first coil.

According to an aspect of the present invention, there is provided an electromagnetic induction type acoustic transducer apparatus which is comprised of a magnetic gap formed between a plate and a pole piece serving as an assembly of a magnetic circuit, a conductive ring attached to a diaphragm interposed in the magnetic gap, the diaphragm for generating sounds when it is vibrated, a coil housing portion disposed in the plate or the pole piece at the position opposing the magnetic gap and a coil housed in the coil housing portion and of which winding is increased in the direction perpendicular to the vibrating direction of the diaphragm.

According to the above-mentioned electromagnetic induction type acoustic transducer apparatus, firstly, a sensitivity can be increased without making the acoustic transducer large in size and without making the acoustic transducer expensive. Secondly, sounds of low tone can be reproduced or picked up, thereby making it possible to realize a transducer of whole band range type or a transducer specialized in reproducing low-frequency signals of large amplitude. Thirdly, an allowable input level of a transducer can be increased from a standpoint of a head-radiation of a first coil.

BRIEF DESCRIPTION OF THE DRAWINGS

FIG. 12 is a diagram showing a relationship between respective bits of a digital audio signal and respective coils in the converter apparatus shown in FIG. 11;

DETAILED DESCRIPTION OF THE PREFERRED EMBODIMENTS

The manner in which several embodiments according to the present invention are applied to a speaker will be described hereinafter.

Figure 1:
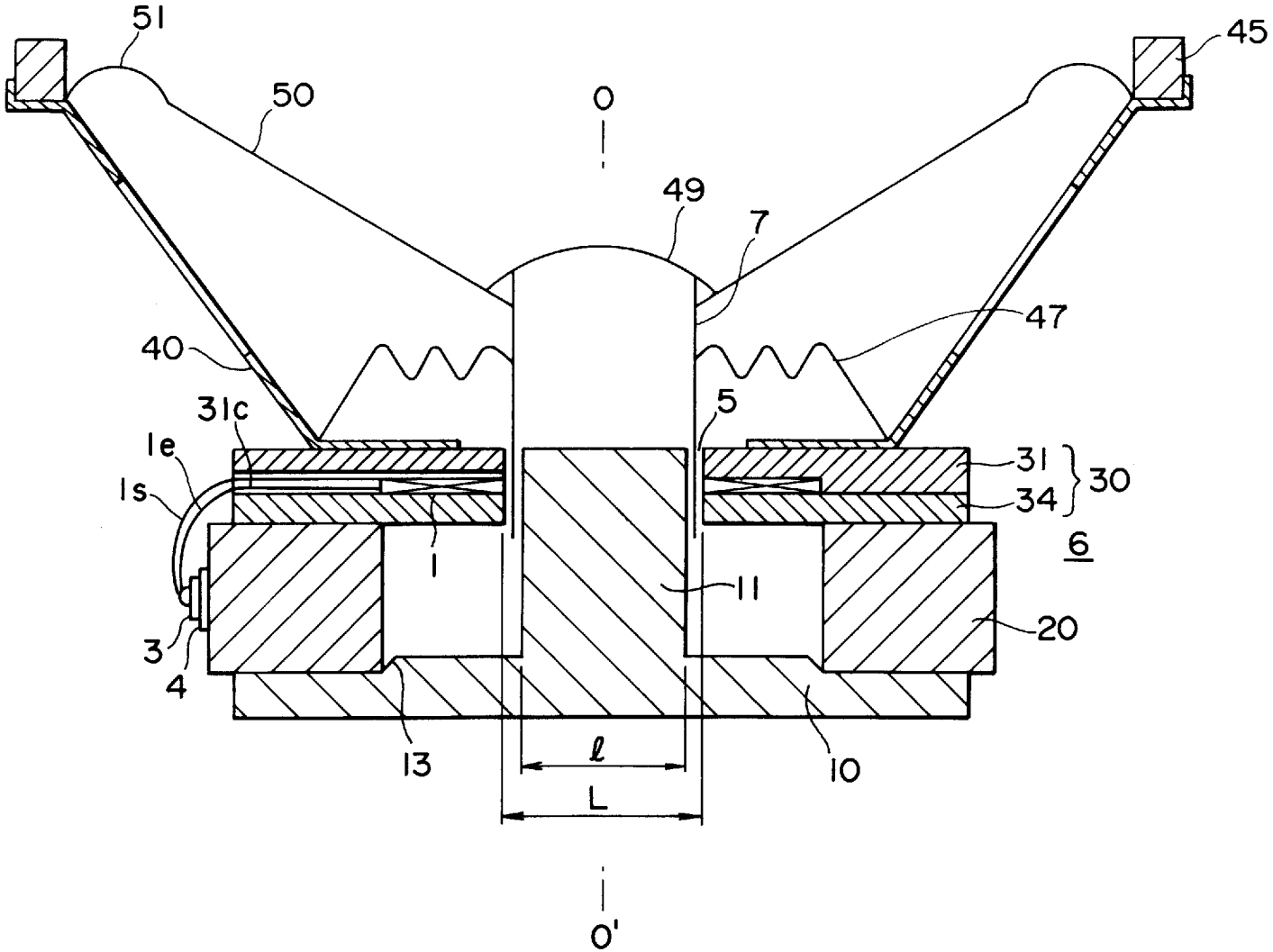
FIG. 1 is a cross-sectional view showing an embodiment in which an electromagnetic induction type acoustic transducer apparatus according to the present invention is applied to an external magnet type speaker.

FIG. 1 shows an acoustic transducer according to a first embodiment of the present invention. In the first embodiment, the present invention is applied to an outer magnetic type electromagnetic coupling speaker in which a drive coil is attached to a plate.

In this embodiment, as shown in FIG. 1, a center pole 11 of circular cylinder configuration having an outer peripheral diameter 1 is unitarily formed on an upper front center portion of a disk-like yoke 10 made of a magnetic material. An annular magnet 20 is attached to the upper surface peripheral portion of the disk-like yoke 10. An annular plate 30 made of a magnetic material and which has a central opening 31*a* with a predetermined diameter L is attached to the upper surface of the magnet 20. Incidentally, the diameter L of the central opening 31*a* of the plate 30 is selected to be smaller than the inner peripheral diameter of the annular magnet 20. Also, the outer peripheral diameter 1 of the center pole 11 is made smaller than the diameter L of the central opening 31*a*. As shown in FIG. 1, the upper end portion of the plate 30 is inserted into the central opening 31*a* and the upper surface of the plate 30 and the upper end face of the center pole 11 are made substantially flush with each other, whereby a clearance between the central opening, i.e. inner peripheral surface of the annular plate 30 and the outer peripheral surface of the upper end portion of the center pole 11 is formed as a magnetic gap 5. Then, the yoke 10 comprising the magnet 20, the plate 30 and the center pole 11 and the magnetic gap 5 formed of the plate 30 and the center pole 11 constitute a magnetic circuit.

Incidentally, the plate 30 is divided along a central axis 0–0' direction of the speaker to provide an upper plate 31 and a lower plate 34. A drive coil (primary coil) 1 having a flat winding is disposed between the upper plate 31 and the lower plate 34.

A secondary coil 7 is inserted into the magnetic gap 5. The secondary coil 7 is a conductive ring made of a nonmagnetic conductive material such as aluminum, i.e. insulated cylindrical body having one turn or an insulated winding having a plurality of turns.

A bottom portion of a frame 40 is attached to the upper surface of the plate 30, and an edge 51 and a gasket 45 are attached to the upper outer peripheral portion of a diaphragm 50 made of a suitable material such as cone. This gasket 45 is attached to the upper tip end portion of the frame 40. Also, the outer peripheral portion of a damper 47 is attached to the frame 40, and an inner peripheral portion of the diaphragm 50 and the inner peripheral portion of the damper 47 are attached to the secondary coil 7. A center cap 49 is attached to the inner peripheral portion of the diaphragm 50 or the upper end portion of the secondary coil 7.

Figure 5A:
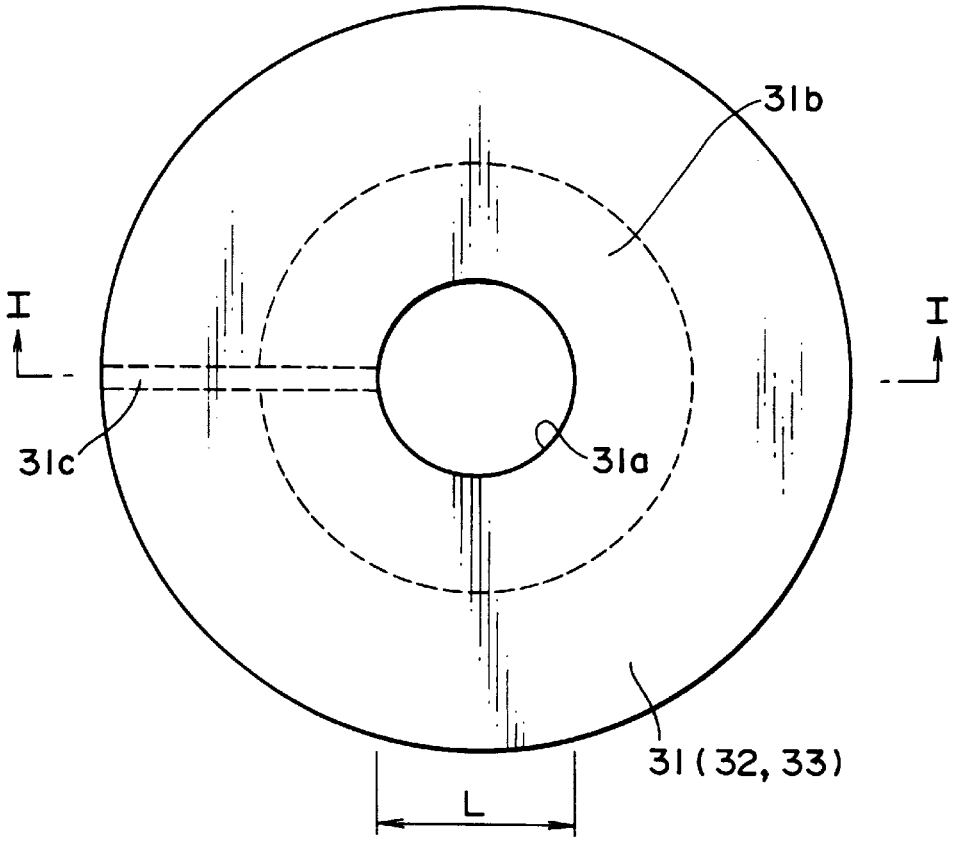
FIG. 5A is a plan view of an upper plate of an electromagnetic induction type acoustic transducer apparatus according to an embodiment of the present invention.
Figure 5B:
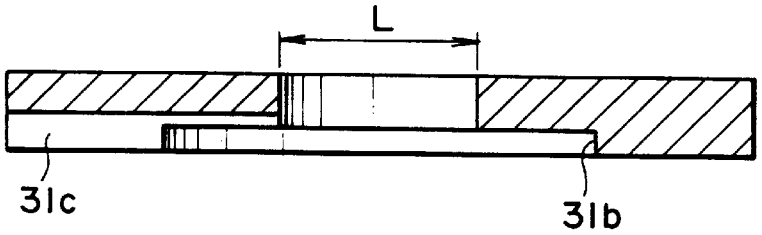
FIG. 5B is a cross-sectional view of the upper plate of the electromagnetic induction type acoustic transducer apparatus according to an embodiment of the present invention.

As shown in FIG. 5 (FIG. 5A is a plan view of the upper plate 31 and FIG. 5B is a cross-sectional view taken along the line B–B' in FIG. 5A), the lower surface of the upper plate 31 has a recess portion serving as a coil housing portion 31*b* defined around the central opening 31*a* and also has a groove 31*c* extending from the inner to outer peripheral surfaces at a lower predetermined angle position. The groove 31*c* is made slightly deeper than the recess portion 31*b*.

Figure 6A:
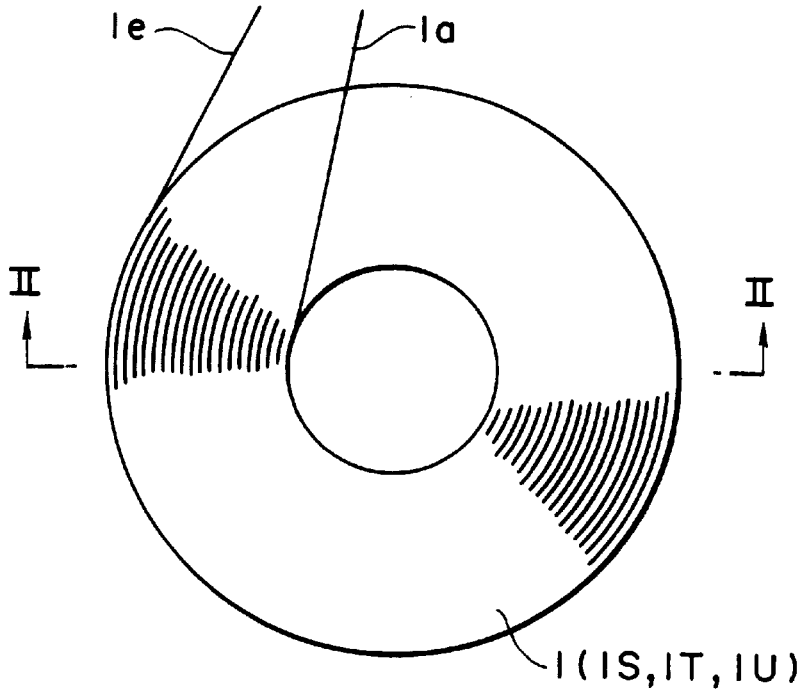
FIG. 6A is a plan view of a drive coil of the electromagnetic induction type acoustic transducer apparatus according to an embodiment of the present invention.
Figure 6B:
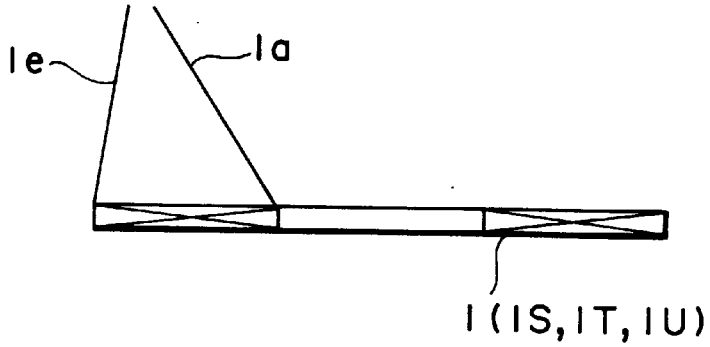
FIG. 6B is a cross-sectional view of the drive coil of the electromagnetic induction type acoustic transducer apparatus according to an embodiment of the present invention.

FIG. 6 shows the drive coil 1. More specifically, FIG. 6A is a plan view of the drive coil 1, and FIG. 6B is a cross-sectional view taken along the line B–B' in FIG. 6A. The drive coil 1 has an annular winding so as to form a central aperture with substantially the same diameter of the diameter L of the central opening 31*a* of the plate 30. Also, as shown in FIG. 6, the drive coil 1 has a winding which increases much more in the direction perpendicular to the central axis 0–0' than the central axis 0–0', i.e. the drive coil 1 has a flat winding.

Then, this drive coil 1 is bonded into the recess portion 31*b* of the upper plate 31 shown in FIG. 5 by an adhesive. As shown in FIG. 1, lead wires 1*s* and 1*e* are fixed within the groove 31*c* of the upper plate 31 by an adhesive, and led out to the outside of the upper plate 31. Then, the lower plate 34 is bonded to the rear side of the upper plate 31 by an adhesive.

Figure 10:
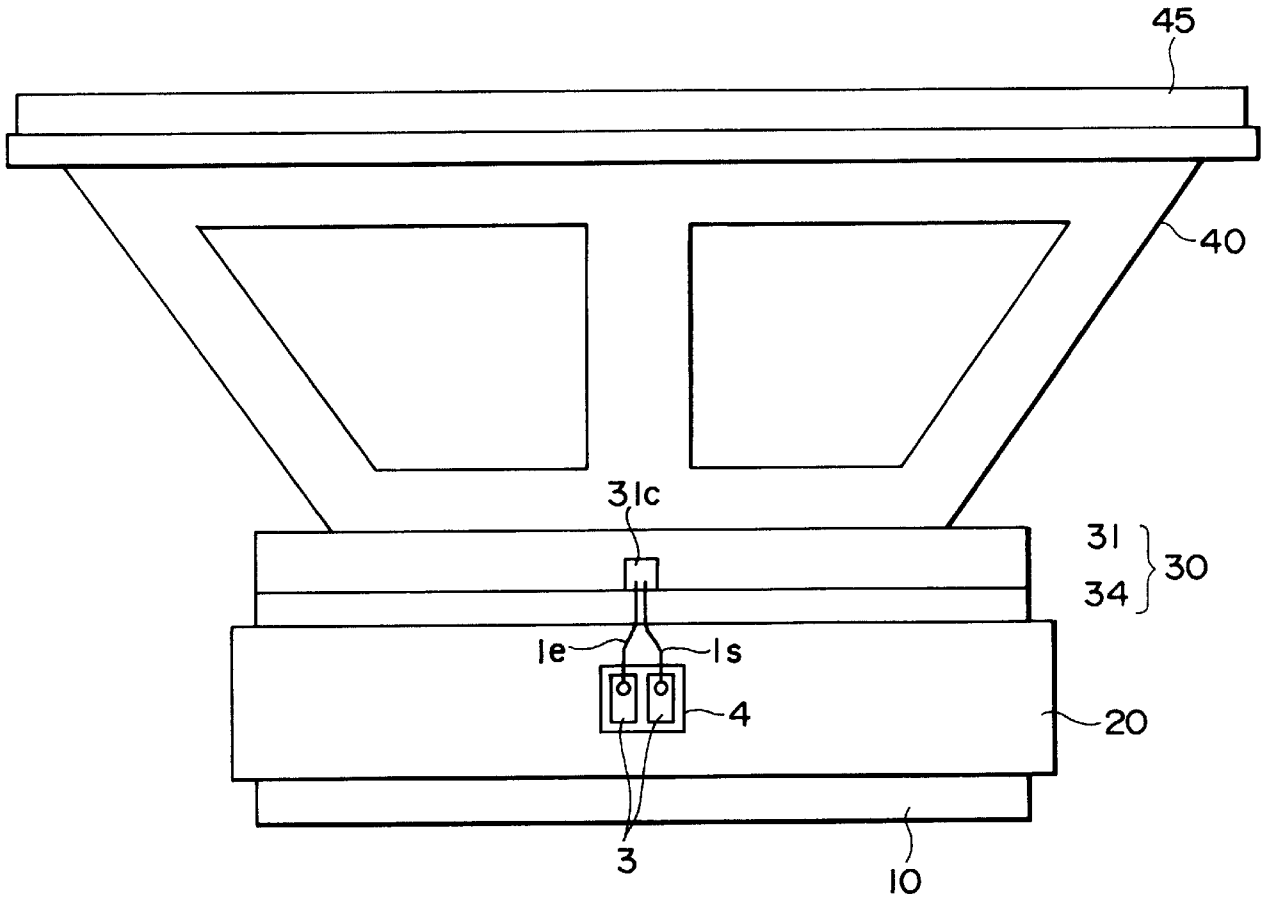
FIG. 10 is a side view in FIG. 1.

Then, as shown in FIG. 10, a terminal assembly 4 with an input terminal 3 attached thereto is attached to the outer peripheral side surface of the magnet 20, and the lead wires 1*s* and 1*e* which were led out to the outside of the upper plate 31 are connected to the input terminal 3 by soldering. The lead wires 1*s* and 1*e* are connected to separate input terminals, respectively.

In the gap width direction, the inner periphery of the drive coil 1 is located at the inner peripheral surfaces of the upper plate 31 and the lower plate 34 in an opposing relation to the magnetic gap 5, and the outer periphery of the drive coil 1 is located near the inner peripheral surface of the magnet 20. Consequently, since a magnetic force within the magnetic gap 5 can be utilized sufficiently, as will be described later on, a sensitivity of speaker can be increased sufficiently, and also an electromagnetic coupling force between the drive coil 1 and the secondary coil 7 can be increased sufficiently in the low band range.

In the above-mentioned electromagnetic coupling speaker, when a signal current is supplied to the drive coil 1, a secondary current corresponding to the signal current is induced in the secondary coil 7 due to an electromagnetic coupling and a drive force corresponding to the signal current is generated in the secondary coil 7 owing to the Fleming's left-hand rule. Then, the diaphragm 50 to which the secondary coil 7 is fixed is vibrated in the upper and lower direction, i.e. central axis 0–0' direction, thereby resulting in a sound pressure corresponding to the signal current being generated.

According to this embodiment, only the inner periphery of the drive coil 1 is faced to the magnetic gap 5, and the drive coil 1 does not exist within the magnetic gap 5. Accordingly, the length of the magnetic gap 5 becomes equal to such one which results from adding a clearance to the thickness of the secondary coil 7. Thus, the length of the magnetic gap 5 can be reduced sufficiently regardless of the line diameter and the number of turns of the drive coil 1. Therefore, without using a large magnet as the magnet 20, i.e. without making the speaker become large in size and without making the speaker become expensive, the magnetic force at the magnetic gap 5 can be increased so that the sensitivity of the speaker can be improved.

In actual practice, if the thickness of the secondary coil 7 is about 0.15 mm, then the length of the magnetic gap 5 can be considerably reduced to about 0.55 mm which results from adding 0.40 mm to 0.15 mm.

In addition, if the number of turns of the drive coil 1 increases in order to increase the inductance of the drive coil 1, then the length of the magnetic gap 5 is not increased and the sensitivity of the speaker is not lowered. Thus, the inductance of the drive coil 1 can be increased. As a consequence, the electromagnetic coupling force between the drive coil 1 and the secondary coil 7 can be increased even in the low band range, thereby making it possible to reproduce low-frequency signals of large amplitude. Therefore, it is possible to realize a speaker of a whole band range or a speaker exclusively-designed for reproducing low-frequency signals of large amplitude.

When the electromagnetic coupling type speaker according to this embodiment is formed as a speaker exclusively-designed for reproducing low-frequency signals of larger amplitude, the thickness of the secondary coil 7 is increased a little, the weight of the secondary coil 7 is increased, and the speaker suspension system is made high compliance so that the minimum resonance frequency of the speaker vibration system should preferably be lowered.

Also, even when the secondary coil 7 is formed of an insulated cylindrical body of one turn made of copper heavier than aluminum or the secondary coil 7 has an insulated winding having a plurality of turns of wire material such as copper wires, a mass of the speaker vibration system can be increased so that a minimum resonance frequency can be lowered.

Further, according to the electromagnetic coupling speaker of this embodiment, since the drive coil 1 contacts with the upper plate 31 and the lower plate 34 at its wide outer peripheral surface facing the front side and the rear side of the speaker, a heat can be instantly radiated from the drive coil 1. Therefore, a wire material as thick as 0.25 mm diameter, for example, can be used as the drive coil 1 and also a large current can be rapidly flowed to the drive coil 1. Thus, the level of the allowable input signal can be raised.

Having put these aspects together, it is to be noted that, according to the electromagnetic coupling type speaker of this embodiment, it is possible to realize a speaker of a whole band range or a speaker exclusively-designed for reproducing low-frequency signals of large amplitude which can be miniaturized and made inexpensive and which can be made high in sensitivity and made large in input/output characteristics.

The electromagnetic coupling speaker shown in FIG. 1 can be assembled by the following method.

Initially, the drive coil 1 is wound as shown in FIG. 6. Then, the drive coil 1 is bonded to the inside of the recess portion 31*b* of the upper plate 31 by an adhesive. Then, the lead wires 1*s* and 1*e* are fixed within the recess portion 31*c* of the upper plate 31 by an adhesive, and led out to the outer peripheral side of the upper plate 31.

Then, the upper peripheral portion of the yoke 10 is coated with an adhesive and on which the magnet (precisely, magnet obtained before being magnetized) 20 rests. At that time, the center of the center pole 11 and the center of the magnet 20 are aligned on the central axis 0–0' direction. To the magnet 20, there is attached the terminal assembly 4 on which the input terminal 3 was attached in advance.

Then, an adhesive is coated on the upper surface of the magnet 20, and the lower plate 34 is bonded to the upper surface of the magnet 20. Then, the magnet 20 is inserted into the center pole 11 in such a manner that the inner diameter of the lower plate 34 becomes concentric with the central axis 0–0'.

Further, an adhesive is coated on the upper surface of the lower plate 34 on which the upper plate 31 with the drive coil 1 fixed thereto is attached in such a manner that the drive coil 1 is opposed to the lower plate 34 side. At that time, the inner peripheral diameter of the upper plate 31 is made concentric with the central axis 0–0'. Then, after the adhesive was dried, the lower plate 34 is extracted from the center pole portion 11.

At this stage, the upper plate 31 and the lower plate 34 are fixed, and the magnetic gap 5 having the predetermined length is formed between the inner peripheral surface of the plate 30 and the outer peripheral surface of the tip end portion of the center pole portion 11. At this stage, the lead wires 1*s* and 1*e* of the drive coil 1 can be connected to the input terminal 3.

Then, the frame 40 is attached to the plate 30 by some suitable means such as screws. Alternatively, the frame 40 may be attached to the upper plate 31 in advance by some suitable means such as screws.

Then, a coil spacer, not shown, is inserted into the inner diameter of the secondary coil 7, and the coil spacer is inserted into the center pole portion 11 in such a manner that the secondary coil 7 may be located at a predetermined position of the magnetic gap 5.

Then, the outer peripheral portion of the damper 47 is bonded to the frame 40, and the inner peripheral portion thereof is bonded to the secondary coil 7. Also, the edge 51 and the gasket 45 at the outer peripheral portion of the diaphragm 50 are bonded to the frame 40, and the inner peripheral portion of the diaphragm 50 is bonded to the secondary coil 7. The lead wires 1*s* and 1*e* of the drive coil 1 may be connected to the input terminal 3 at this stage.

Then, after the adhesive was dried, the above-mentioned coil spacer is extracted from the center pole portion 11, and a center cap 49 is bonded to the inner peripheral portion of the diaphragm 50 or the tip end portion of the secondary coil 7. After the adhesive was dried, the assembly process of the speaker is completed by magnetizing the magnet 20.

Figure 7A:
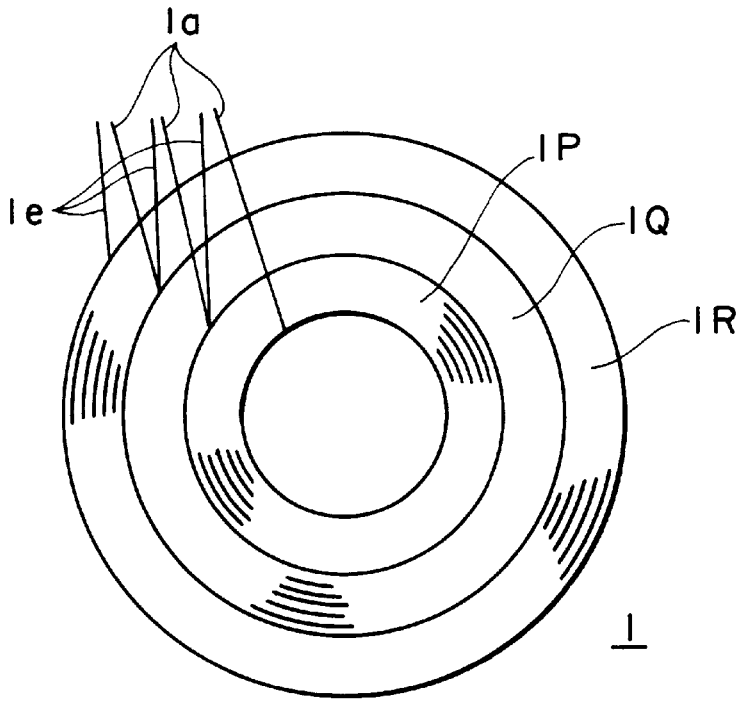
FIG. 7A is a plan view of a drive coil of the electromagnetic induction type acoustic transducer apparatus according to other embodiment of the present invention.
Figure 7B:
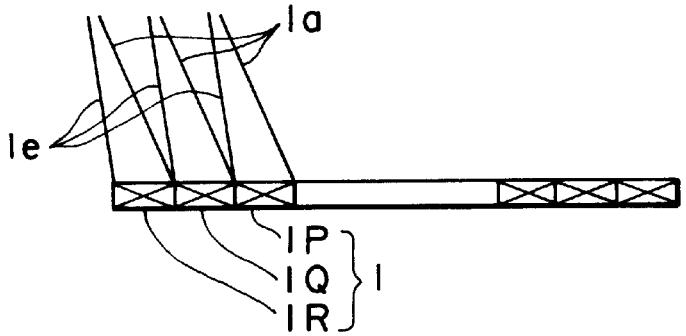
FIG. 7B is a cross-sectional view of the drive coil of the electromagnetic induction type acoustic transducer apparatus according to other embodiment of the present invention.

Incidentally, as shown in FIG. 7, the above-mentioned drive coil 1 may comprise three coils 1P, 1Q, 1R, for example, each of which is divided and wound in the gap width direction (in the direction perpendicular to the central axis 0–0' direction). In this case, in each of the coils 1P, 1Q, 1R, the inner peripheral side is used as a winding start portion and the outer peripheral side is used as a winding end portion. Lead wires 1*s* and 1*e* are led out from the winding start portion and the winding end portion, respectively.

In this case, if the respective coils 1P, 1Q, 1R are connected in parallel, then a larger input current can be flowed to the drive coil 1 using a thin wire material and a resistance on the primary side of a speaker can be reduced. Thus, a matching with an amplifier which drives the speaker can be made easy.

At that time, although the numbers of the turns of the coils 1P, 1Q, 1R are substantially the same, in order that the resistance values of the coils 1P, 1Q, 1R become the same and that the same current may flow to the coils 1P, 1Q, 1R, the intermediate coil 1Q should preferably be formed of a wire material thicker than that of the inside coil 1P and further the outside coil 1R should preferably be formed of a wire material thicker than that of the intermediate coil 1Q.

Figure 13:
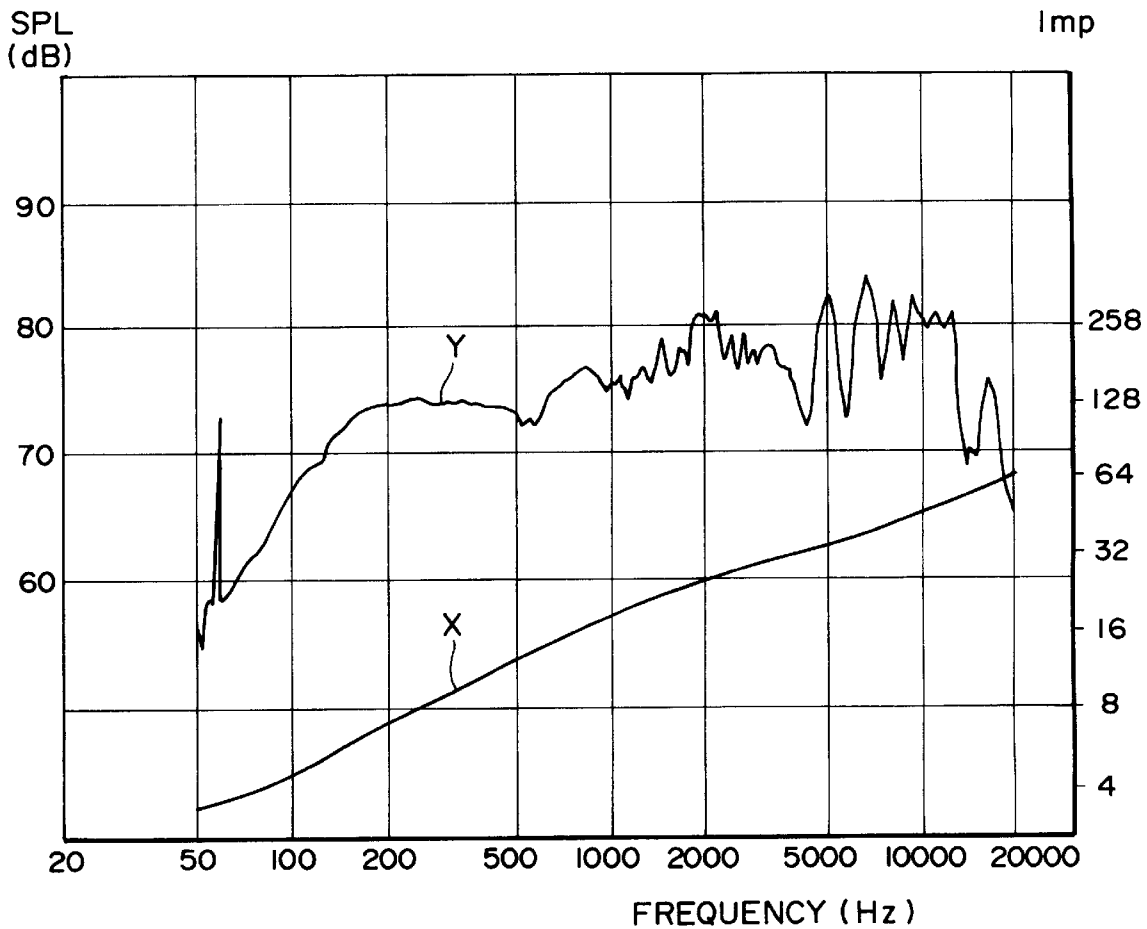
FIG. 13 is a graph graphing measured results of an impedance characteristic curve versus a sound-pressure level characteristic curve in the electromagnetic acoustic transducer apparatus according to the present invention.
Figure 14:
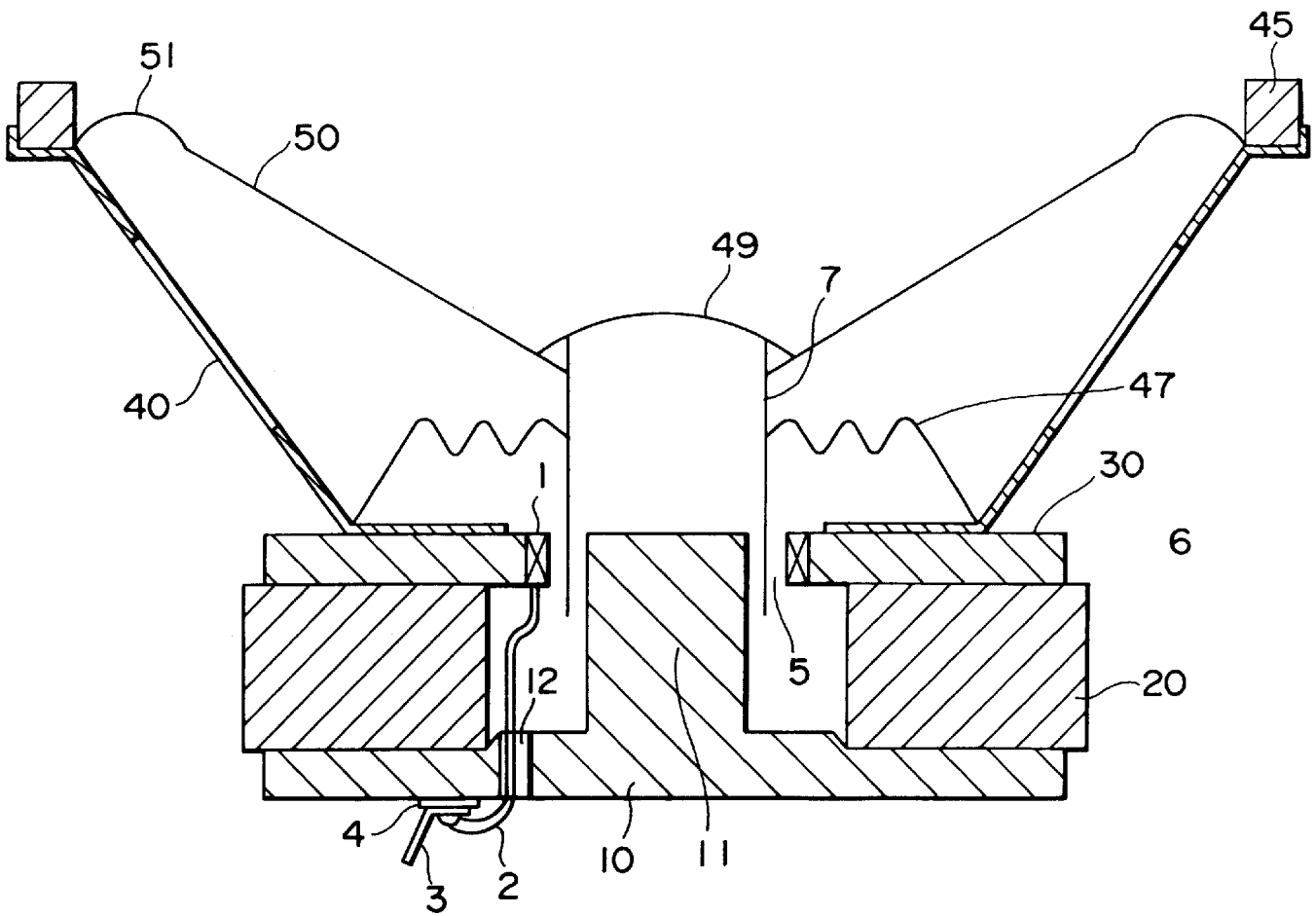
FIG. 14 is a cross-sectional view showing an example in which an electromagnetic induction type acoustic transducer apparatus is applied to a speaker according to the related art.
Figure 15:
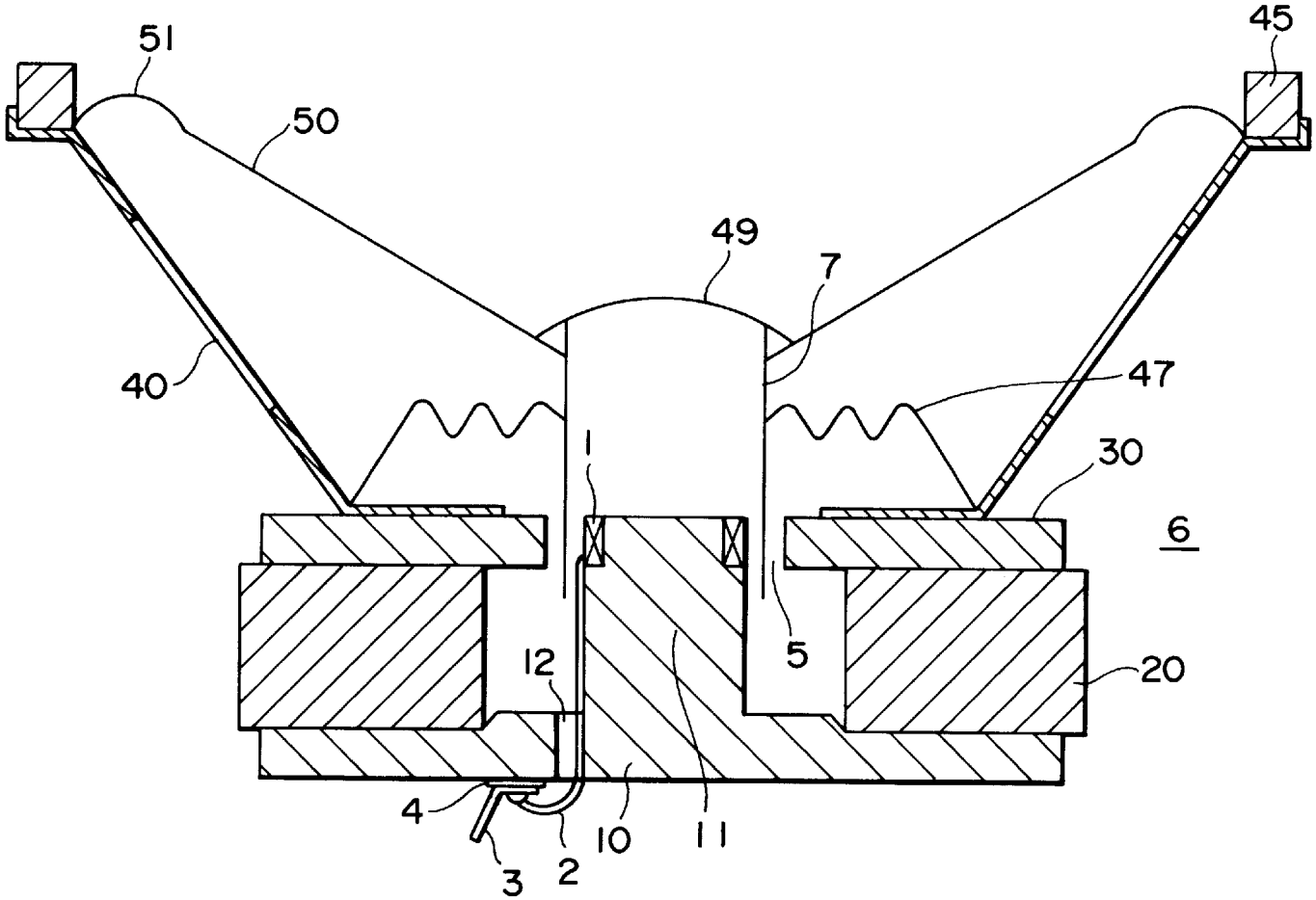
FIG. 15 is a cross-sectional view showing another example in which an electromagnetic induction type acoustic transducer apparatus is applied to a speaker according to the related art.

FIG. 13 is a graph graphing a drive impedance characteristic curve X versus a reproduced sound-pressure level (SPL) characteristic curve Y obtained under the condition that the drive coil 1 of the electromagnetic induction type speaker shown in FIG. 1 has an inner diameter of 26.06 mm, an outer diameter of 43 mm and a thickness of 1.5 mm, a wire material having a diameter of 0.25 mm is wound around the three divided coils 1P, 1Q, 1R shown in FIG. 7 by 124 turns each, i.e. totally 372 turns and that these divided coils 1P, 1Q, 1R are connected in parallel to each other.

A study of FIG. 13 reveals that, according to the electromagnetic coupling type speaker of this embodiment, even when the impedance (Imp) of the drive coil 1 is decreased, a sound-pressure level (SPL) becomes sufficiently large in the low-band range.

Figure 2:
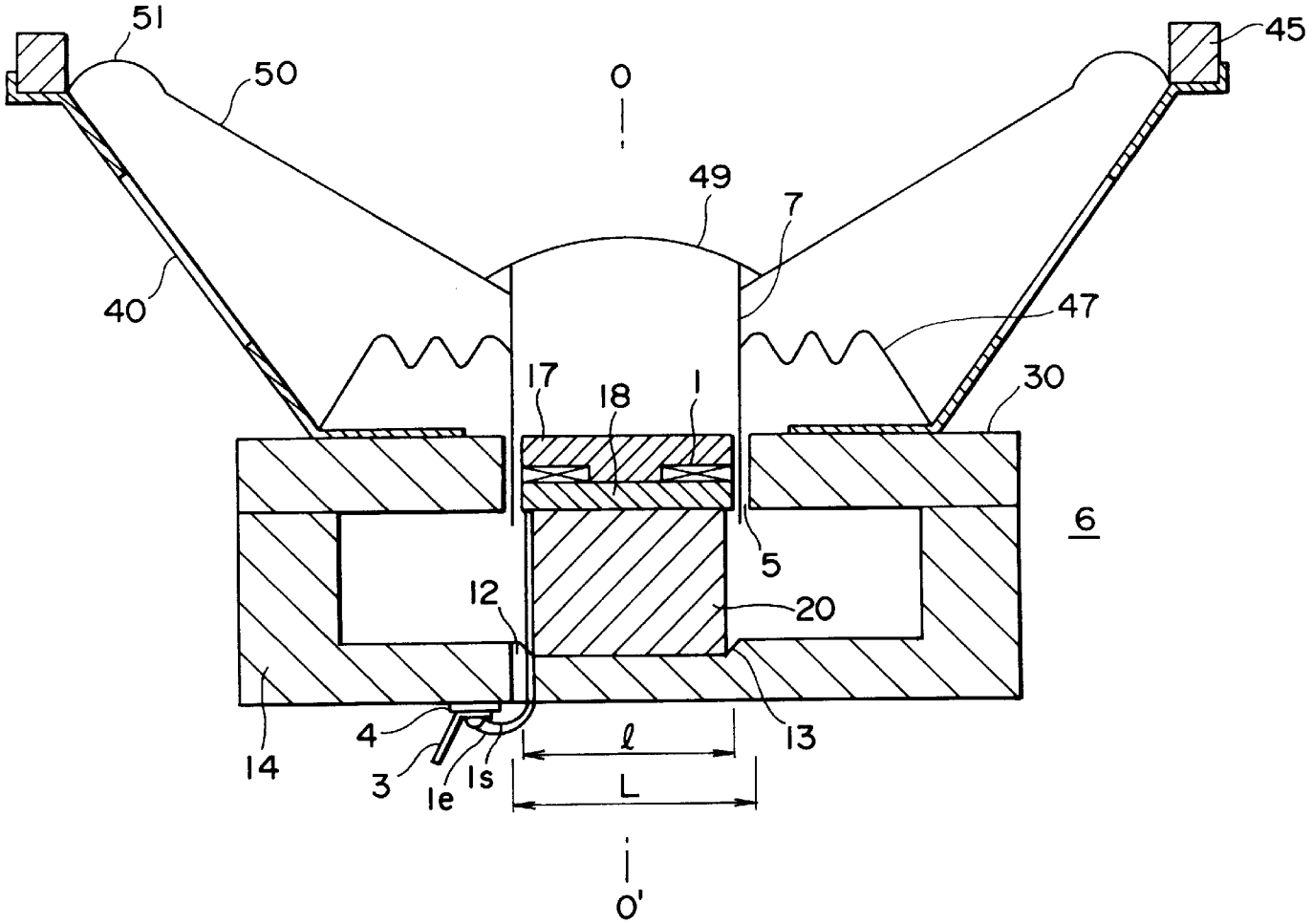
FIG. 2 is a cross-sectional view showing an embodiment in which an electromagnetic induction type acoustic transducer apparatus according to the present invention is applied to an internal magnet type speaker.

FIG. 2 shows an internal magnet type electromagnetic coupling speaker of an acoustic transducer according to the present invention in which a drive coil is disposed on a pole piece.

In this embodiment, a magnet 20 is attached to a front surface of a central portion of a yoke 14, and a pole piece 17 is attached to the upper surface of the magnet 20. The magnet 20 and the pole piece 17 constitute a center pole. Then, the pole piece 17 is divided along the central axis 0–0' of the speaker to provide an upper pole piece 17 and a lower pole piece 18 which are laminated with each other. A drive coil 1 having a flat winding is disposed between the upper pole piece 17 and the lower pole piece 18. The outer peripheral diameters of the upper and lower pole pieces 17, 18 and the drive coil 1 are equal to each other, and an outer diameter of the magnet 20 is made slightly smaller.

An annular shallow recess portion is formed on the outer peripheral portion of the lower surface of the pole piece 17, and a slit is formed at a predetermined angle position of the pole piece 18. The drive coil 1 is attached to the inside of the recess portion of the pole piece 17 by an adhesive. Lead wires 1*s* and 1*e* of the drive coil 1 are fixed to the inside of the slit of the pole piece by an adhesive, and led out to the outer peripheral side of the magnet 20.

The yoke 14 has a pot-like configuration, i.e. the yoke 14 comprises a disk-like flange portion and a cylindrical body unitarily formed with the flange-like peripheral portion. Then, an annular plate 30 having a circular central opening 31*a* is attached to the upper surface of this cylindrical body by bonding. A magnetic gap 5 is formed between the inner peripheral surface of the plate 30, i.e. the central opening 31*a* and the outer peripheral surfaces of the pole pieces 17 and 18.

A through-hole 12 is bored through the disk-like portion of the yoke 14 and a terminal assembly 4 with an input terminal 3 attached thereto is attached to the back surface of the yoke 14. The lead wires 1*s* and 1*e* are fixed to the outer peripheral surface of the magnet 20 by an adhesive, and connected through the through-hole 12 to the input terminal 3.

In FIG. 2, like elements and parts identical to those of the above-mentioned embodiments are marked with the same reference numerals, and therefore need not be described in detail.

Figure 3:
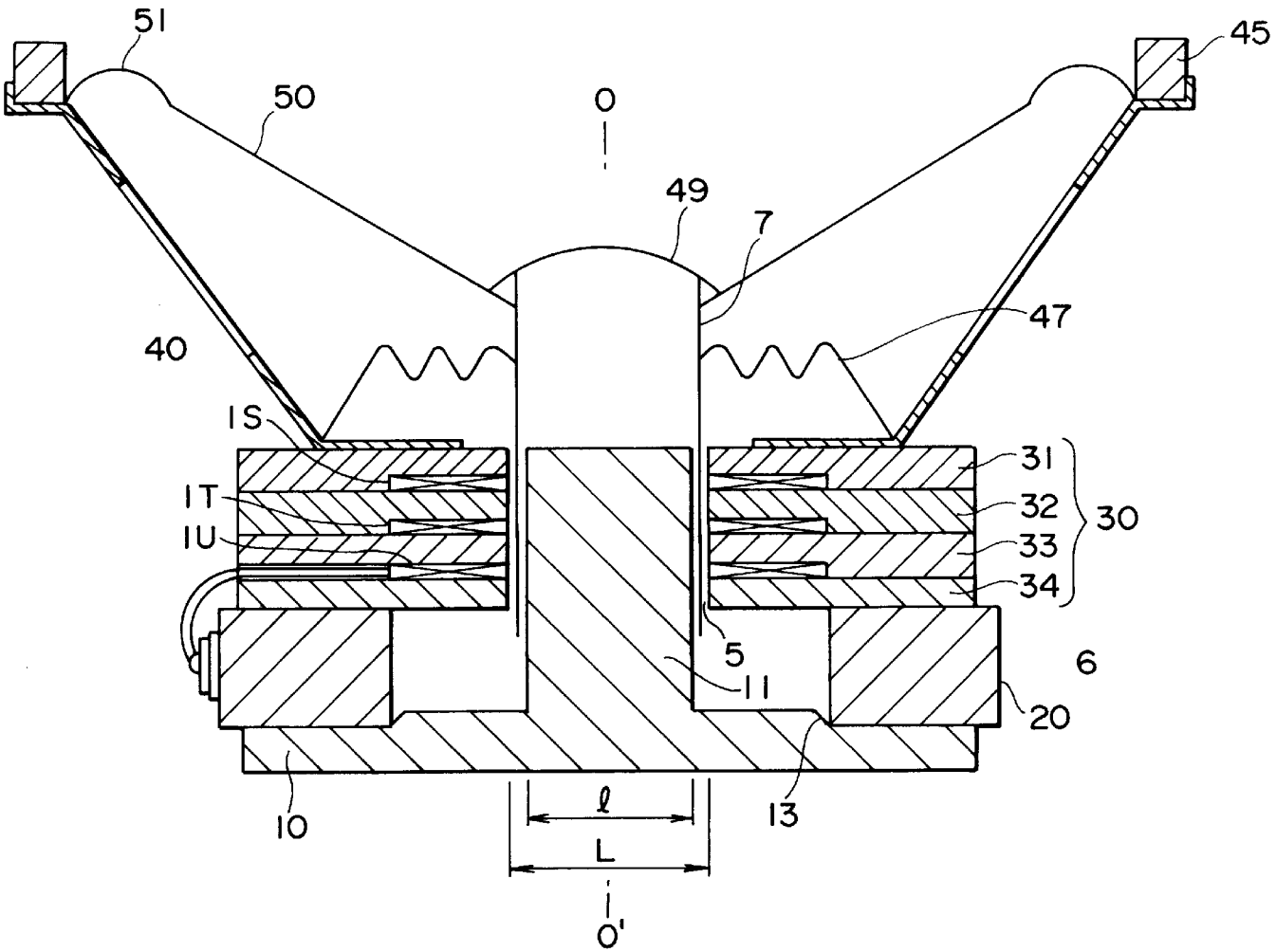
FIG. 3 is a cross-sectional view showing other embodiment in which an electromagnetic induction type acoustic transducer apparatus according to the present invention is applied to an external magnet type speaker.

FIG. 3 shows an acoustic transducer according to a third embodiment of the present invention. According to this embodiment, similarly to the first embodiment of FIG. 1, the acoustic transducer is an electromagnetic coupling speaker of an external magnet type, and drive coils are disposed in a plate and a pole piece.

In this embodiment, a plate 30 is divided along the central axis direction 0–0' of the speaker to provide a first plate 31, a second plate 32, a third plate 33 and a fourth plate 34 from above, in that order. Drive coils 1S, 1T and 1U, each having a flat winding shown in FIG. 6, are disposed between the plates 31 and 32 between the plates 32 and 33 and between the plates 33 and 34.

Similarly to the plate 31 of FIG. 1, in each of the plates 31, 32 and 33, a shallow recess portion 31*b* is formed around the central opening 31*a* of the lower surface, and a groove 31*c* slightly deeper than the recess portion 31*b* is formed at a predetermined angle position of the rear side as shown in FIG. 5.

As shown in FIG. 6, in each of the drive coils 1S, 1T, 1U, each inner peripheral side is used as a winding start portion, and each outer peripheral side is used as a winding end portion. Each of the drive coils 1S, 1T, 1U has an annular winding, and the lead wires 1*s* and 1*e* are led out from the winding start portion and the winding end portion, respectively.

The drive coils 1S, 1T, 1U are respectively attached to the inside portions of the recesses 31*b* of the plates 31, 32, 33 by an adhesive. The lead wires 1*s* and 1*e* are respectively fixed to the inside portions of the grooves 31*c* of the plates 31, 32, 33 by an adhesive, and led out to the outer peripheral sides of the plates 31, 32, 33.

The plate 33 with the drive coil 1U fixed thereto is bonded to the upper surface of the plate 34, the plate 32 with the drive coil 1T fixed thereto is bonded to the upper surface of the plate 33, and the plate 31 with the drive coil 1S fixed thereto is bonded to the upper surface of the plate 32, respectively.

Incidentally, in this case, the grooves 31*c* of the lead wires 1*s* and 1*e* of the plate 32 bonded on the plate 33 and the plate 31 bonded on the plate 32 are disposed at the positions having different predetermined angles. In FIG. 3, like elements and parts identical to those of FIG. 1 are marked with the same reference numerals, and therefore need not be described in detail.

In this case, the drive coils 1S, 1T and 1U may be connected in series. In that case, it is possible to increase the inductance by increasing the number of turns of one drive coil on the whole.

Also, the drive coils 1S, 1T and 1U may be connected in parallel to each other. In that case, since a larger input current may be flowed to one drive coil on the whole and the resistance on the primary side of the speaker is decreased, a matching with an amplifier which drives the speaker can be facilitated.

Figure 4:
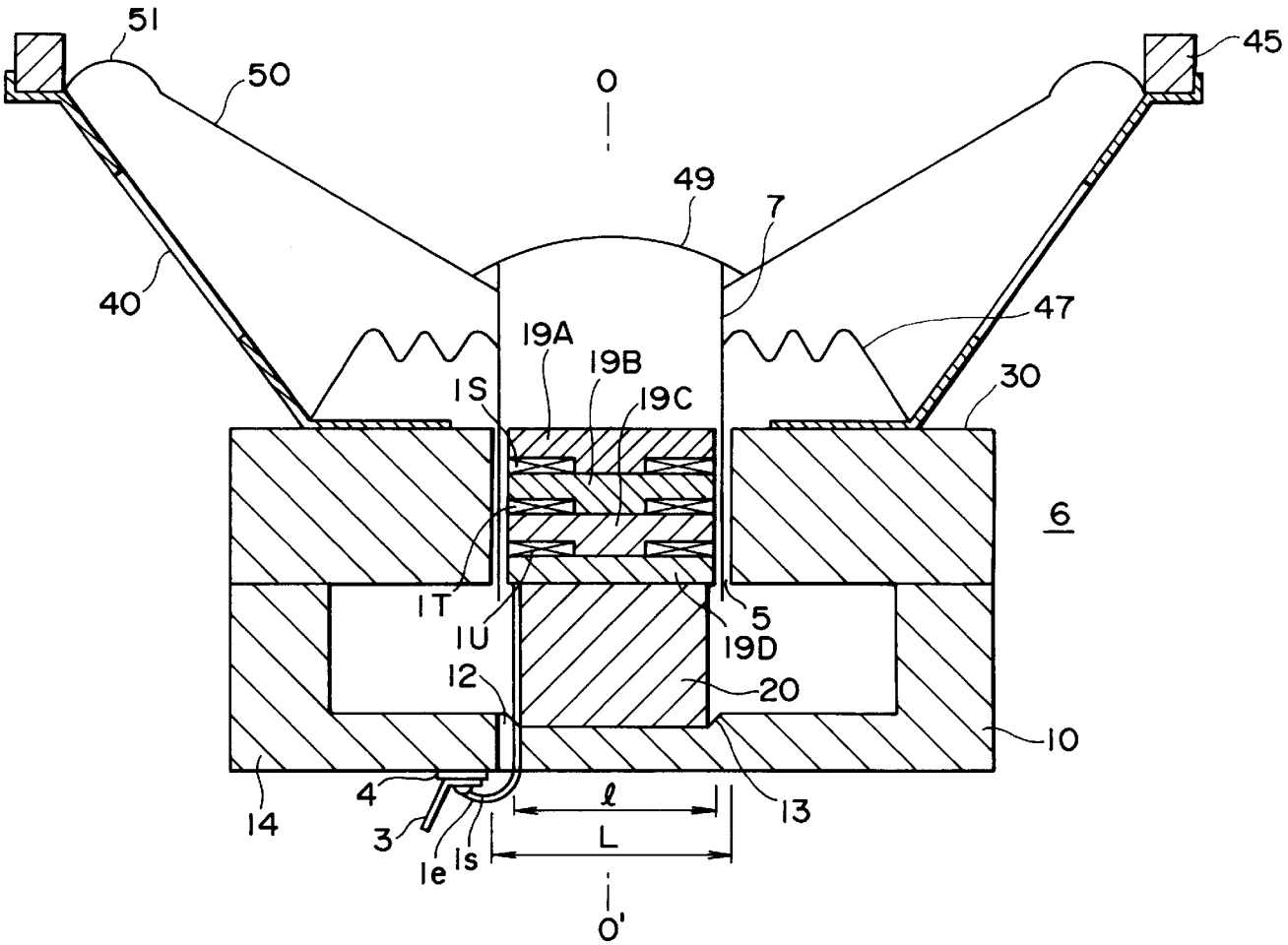
FIG. 4 is a cross-sectional view showing other embodiment in which an electromagnetic induction type acoustic transducer apparatus according to the present invention is applied to an internal magnet type speaker.

FIG. 4 shows an internal magnet type electromagnetic coupling speaker of an acoustic transducer according to other embodiment of the present invention in which drive coils are disposed on pole pieces.

In this embodiment, a pole piece at the front surface side of the magnet 20 is divided along the central axis 0–0' direction of the speaker to provide a first pole piece 19A, a second pole piece 19B, a third pole piece 19C and a fourth pole piece 19D. Then, the drive coils 1S, 1T and 1U, each having a flat winding shown in FIG. 6, are disposed between the pole pieces 19A and 19B, between the pole pieces 19B and 19C and between the pole pieces 19C and 19D, respectively.

An annular shallow groove is downwardly formed in each of the pole pieces 19A, 19B and 19C, and a slit is formed on each of the pole pieces 19B, 19C and 19D at a predetermined angle.

As shown in FIG. 6, in each of the drive coils 1S, 1T and 1U, the inner peripheral side is used as the winding start portion and the outer peripheral side is used as the winding end portion so that each of the drive coils 1S, 1T, 1U has an annular winding. The lead wires 1*s* and 1*e* are led out from the winding start portion and the winding end portion, respectively.

The drive coils 1S, 1T, 1U are attached to the insides of the grooves of the pole pieces 19A, 19B, 19C, respectively. The lead wires 1*s* and 1*e* thereof are fixed into the slits of the pole pieces 19B, 19C, 19D by an adhesive, and then led out to the outer peripheral side of the magnet 20, respectively.

A through-hole 12 is bored through the bottom portion of the yoke 14, and the terminal assembly 4 with the input terminal 3 attached thereto is attached to the back surface of the yoke 14. The lead wires 1*s* and 1*e* are fixed to the outer peripheral surface of the magnet 20 by an adhesive, and connected through the through-hole 12 to the input terminal 3.

In FIG. 4, like elements and parts identical to those of FIGS. 1 and 2 are marked with the same reference numerals, and therefore need not be described in detail.

According to the embodiments shown in FIGS. 3 and 4, the drive coils 1S, 1T and 1U may be connected in series. In that case, it is possible to increase the inductance by increasing the number of turns of one drive coil much more on the whole.

Also, the drive coils 1S, 1T and 1U may be connected in parallel. In that case, a larger input current may be flowed to one drive coil on the whole and a resistance on the primary side of the speaker may be reduced, whereby a matching with an amplifier which drives the speaker can be facilitated.

Furthermore, an example in which the present invention is applied to a speaker that is driven by a digital audio signal will be described below.

Figure 11:
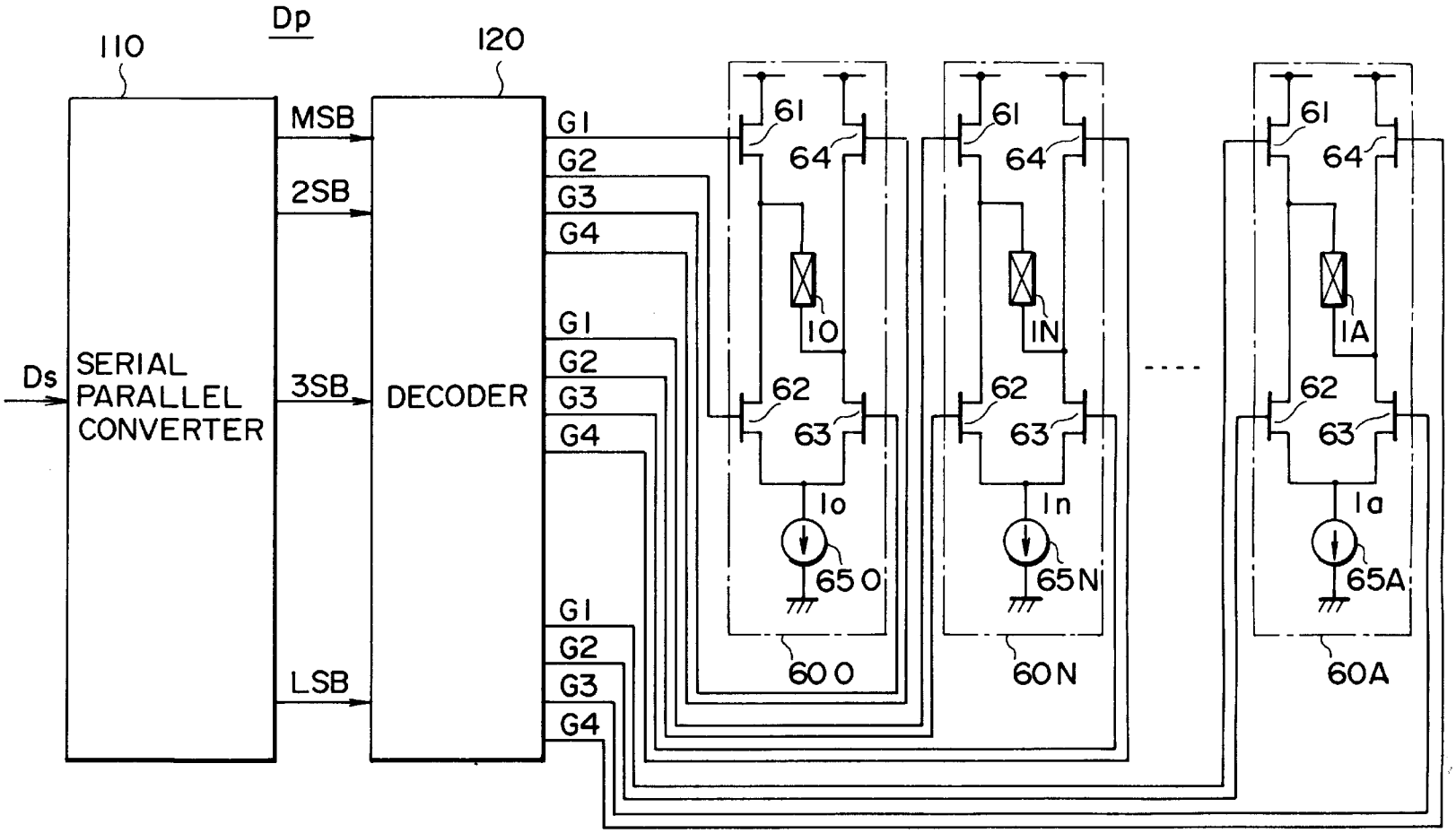
FIG. 11 is a block diagram showing an example of a converter apparatus including a drive apparatus used when a speaker to which the electromagnetic induction type acoustic transducer apparatus according to the present invention is applied is driven by a digital audio signal.

FIG. 11 is a block diagram showing an example of a speaker apparatus including a drive apparatus unit. As shown in FIG. 11, a digital audio signal Ds obtained after inputted data from a CD (compact disc) player or a DAT (digital audio tape recorder) has been digitized into 16-bit digital data at a sampling frequency of 44.1 kHz or 48 kHz is supplied to a serial-to-parallel (S/P converter) converter 110, in which it is converted into a digital audio signal Dp of parallel data.

The 16-bit digital audio signal Dp of parallel data is linearly quantized by two's complement code as shown in FIG. 12. A decoder 120 decodes such a digital audio signal Dp to generate four control signals G1 to G4, which will be described later on, with respect to each of 2SB to LSB (least significant bit) of low-order 15 bits except MSB (most significant bit) in which case the MSB of the digital audio signal Dp is used as a sign bit.

Figure 8A:
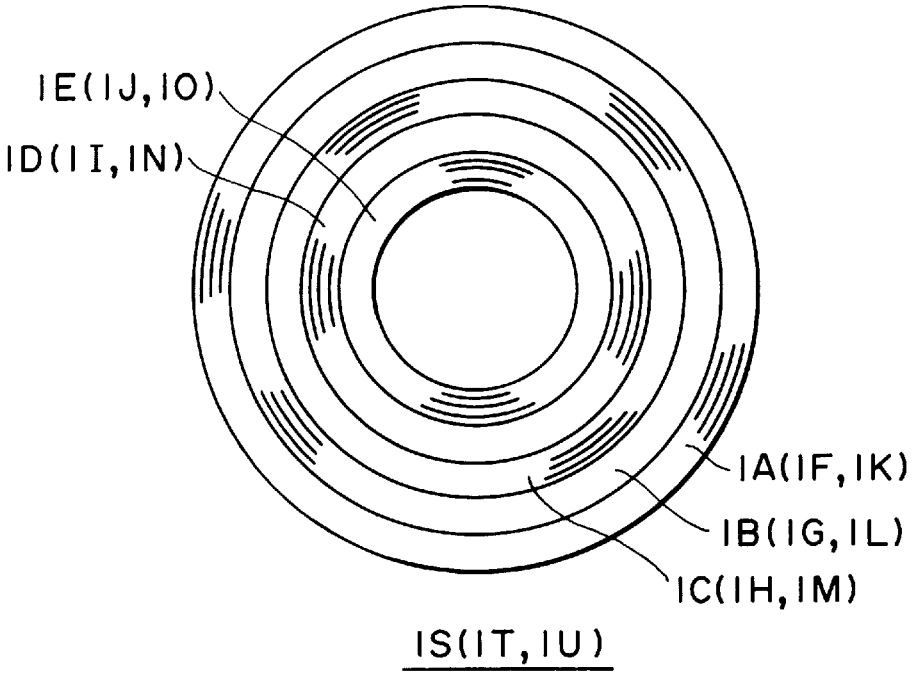
FIG. 8A is a plan view of the drive coil of the electromagnetic induction type acoustic transducer apparatus according to a further embodiment of the present invention.
Figure 8B:
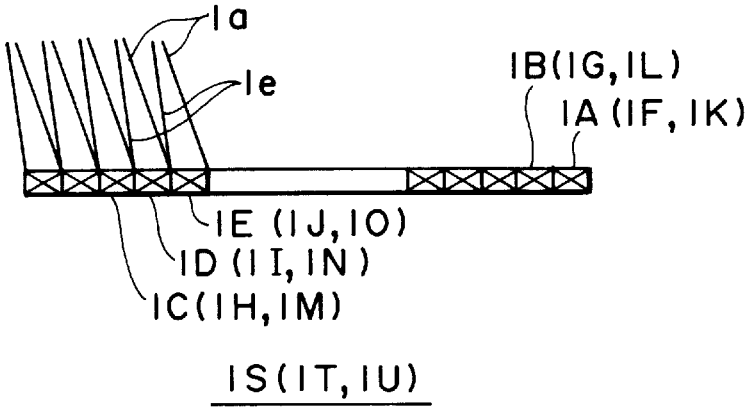
FIG. 8B is a cross-sectional view of the drive coil of the electromagnetic induction type acoustic transducer apparatus according to a further embodiment of the present invention.

The speaker includes the three drive coils 1S, 1T, 1U each of which has a flat and cylindrical winding shown in FIG. 3 or 4. Each of the drive coils 1S, 1T, 1U is divided along the gap width direction to provide the five coils 1E to 1A, 1J to 1F and 1O to 1K each of which has the equal number of turns as shown in FIG. 8. Also, in this case, in each of the coils 1E to 1A, 1J to 1F and 1O to 1K, the inner peripheral side is used as the winding start portion, and the outer peripheral side is used as the winding end portion, respectively. The lead wires 1*s* and 1*e* are led out from the winding start portion and the winding end portion, respectively.

Figure 9A:
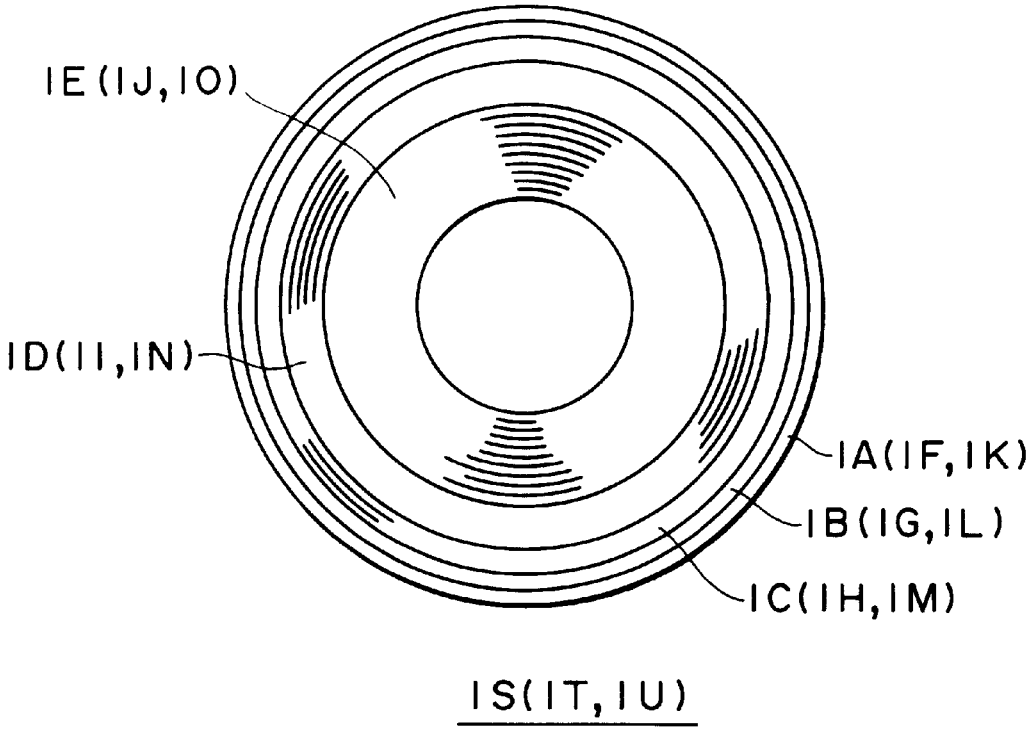
FIG. 9A is a plan view of the drive coil of the electromagnetic induction type acoustic transducer apparatus according to yet a further embodiment of the present invention.
Figure 9B:
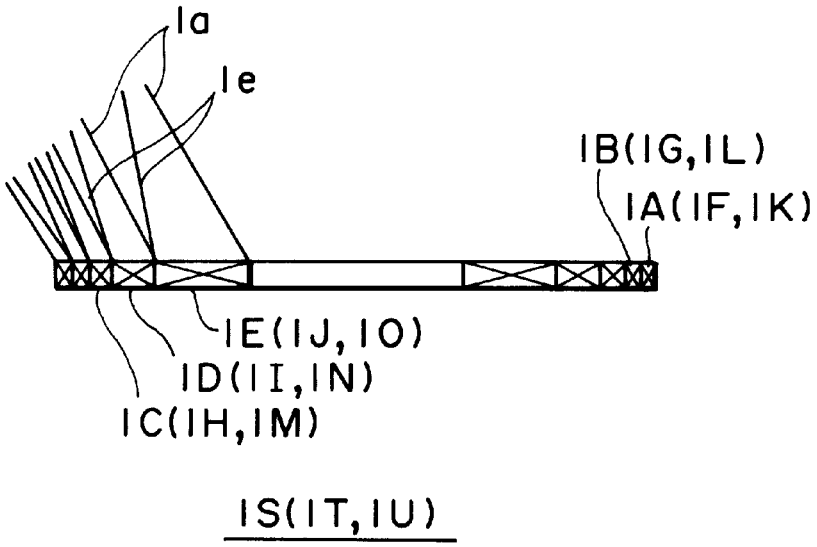
FIG. 9B is a cross-sectional view of the drive coil of the electromagnetic induction type acoustic transducer apparatus according to yet a further embodiment of the present invention.

Alternatively, as shown in FIG. 9, each of the drive coils 1S, 1T, 1U is divided along the gap width direction to provide the five coils 1E to 1A, 1J to 1F and 1O to 1K in which the ratio of the number of turns becomes N:N/2:N/4:N/8:N/16. Also in this case, in each of the coils 1E to 1A, 1J to 1F and 1O to 1K, the inner peripheral side is used as the winding start portion, and the outer peripheral side is used as the winding end portion, respectively. The lead wires 1*s* and 1*e* are led out from the winding start portion and the winding end portion, respectively.

Then, when the drive coils are divided to provide 15 coils 1A to 10 in total as shown in FIG. 8 or 9, the drive coils may be driven by a 16-bit digital audio signal.

Then, as shown in FIG. 12, the coil 1A is associated with the LSB of the digital audio signal Dp. The coils 1B, 1C, . . . , 1N, 10 will hereinafter be associated with 15SB, 14SB, . . . , 3SB, 2SB of the digital audio signal Dp. Then, as shown in FIG. 11, there are provided coil drive circuits 60A, . . . , 60N, 60O in response to the coils 1A, . . . 1N, 1O, respectively.

As shown in FIG. 11, the coil drive circuit 60A, for example, comprises a constant current source 65A, four FETs (field-effect transistors) 61 to 64 serving as switching elements and the corresponding coil 1A which are connected in a bridged connection fashion. When the FETs 61, 63 are held at ON state and the FETs 62, 64 are held at OFF state, a current Ia of the constant current source 65A is flowed to the coil 1A in the positive direction. When the FETs 61, 63 are held at OFF state and the FETs 62, 64 are held at ON state, the current Ia of the constant current source 65A is flowed to the coil 1A in the negative direction. When the FETs 61 to 64 are all held at ON or OFF state, the current Ia is not flowed to the coil 1A. This is also true in other coil driving circuits.

Then, the control signals G1 to G4 outputted from the decoder 120 with respect to the 2SB, 3SB, . . . , LSB of the digital audio signal Dp are supplied to the gates of the FETs 61 to 64 of the corresponding coil drive circuits 60O, 60N, . . . , 60A, respectively.

With respect to the control signals G1 to G4, when the MSB of the digital audio signal Dp is 0 and corresponding low-order bits are 1, the control signals G1, G3 are held at the level in which the FETs 61, 63 are turned ON, and the control signals G2, G4 are held at the level in which the FETs 62, 64 are turned OFF. When the MSB is 0 and corresponding low-order bits are 0 or when the MSB is 1 and corresponding low-order bits are 1, the control signals G1 to G4 are held at the level in which the FETs 61 to 64 are turned OFF. When the MSB is 1 and corresponding low-order bits are 0, the control signals G1, G3 are held at the level in which the FETs 61, 63 are turned OFF, and the control signals G2, G4 are held at the level in which the FETs 62, 64 are turned ON.

Therefore, under the condition that the MSB is 0, only when a certain low-order bit is 1, then a signal current is flowed to a corresponding coil in the positive direction. Conversely, under the condition that the MSB is 1, only when a certain low-order bit is 0, a signal current is flowed to a corresponding coil in the negative direction.

A drive force F of a vibration system of an electric acoustic transducer of an electromagnetic coupling type such as an electromagnetic coupling speaker is expressed by a product of a secondary current i induced in a secondary coil, a density B of magnetic flux generated in a magnetic gap of a magnetic circuit and a length L of a secondary coil disposed within the magnetic gap of the magnetic circuit as F=Bli. Since the magnetic flux density B and the length L are constant, the drive force F of the vibration system becomes proportional to the secondary current i induced in the secondary coil. Then, the secondary current i induced in the secondary coil is in proportion to a product of a signal current flowed to a drive coil (primary coil) and the number of turns of the drive coil.

Then, when the number of turns of the 15 coils 1A to 1O is equal as shown in FIG. 8, currents Ib, Ic, Id, . . . of the constant current sources 65B, 65C, 65D, . . . of the coil drive circuits 60B, 60C, 60D, . . . corresponding to the coils 1B, 1C, 1D, . . . corresponding to 15SB, 14SB, 13SB, . . . of the digital audio signal Dp are set on the basis of a relationship of the current Ia of the constant current source 65A of the coil drive circuit 60A corresponding to the coil 1A corresponding to the LSB of the digital audio signal Dp as Ib=2Ia, Ic=2Ib=4Ia, Id=2Ic=8Ia.

Accordingly, in this case, as shown in FIG. 3 or 4, the diaphragm 50 with the secondary coil 7 fixed thereto is displaced by an amount proportional to the weights of the bits corresponding to the 15 coils 1A to 1O in the direction corresponding to the value of the MSB of the digital audio signal Dp, whereby the digital audio signal Dp is reproduced with a high fidelity.

Further, as shown in FIG. 9, when the ratio of the number of turns of the coils 1E, 1J, 1O and the coils 1D, 1I, 1N and the coils 1C, 1H, 1M and the coils 1B, 1G, 1L and the coils 1A, 1F, 1K is set to N:N/2:N/4:N/8:N/16, currents Ib, Ic, Id, Ie, If, Ig, Ih, Ii, Ij, Ik, Il, Im, In, Io of the constant current sources 65B, 65C, 65D, 65E, 65F, 65G, 65H, 65I, 65J, 65K, 65L, 65M, 65N, 65O of the coil drive circuits 60B, 60C, 60D, 60E, 60F, 60G, 60H, 60I, 60J, 60K, 60L, 60M, 60N, 60O corresponding to 15SB, 14SB, 13SB, 12SB, 11SB, 10SB, 9SB, 8SB, 7SB, 6SB, 5SB, 4SB, 3SB, 2SB of the digital audio signal Dp are set on the basis of a relationship of the current Ia of the constant current source 65A of the coil drive circuit 60A corresponding to the coil 1A corresponding to the LSB of the digital audio signal Dp as Ia=Ib=Ic=Id=Ie, If=Ig=Ih=Ii=Ij=32I*a*, Ik=Il=Im=In=Io=32I*f*=32×32I*a*.

Accordingly, also in this case, the diaphragm 50 with the secondary coil 7 fixed thereto as shown in FIG. 3 or 4 is displaced by the amounts proportional to the weights of the bits corresponding to the 15 coils 1A to 1O in the direction corresponding to the value of the MSB of the digital audio signal Dp, whereby the digital audio signal Dp is reproduced with a high fidelity. In addition, in this case, a ratio of current values between the minimum current value and the maximum current value can be reduced as small as 1:32×32.

The speaker vibration system can hardly reproduce a high frequency component exceeding 20 kHz. Accordingly, even when the respective coils 1A to 1O of the drive coil are driven by the digital audio signal Dp of the sampling frequency of 44.1 kHz or 48 kHz as shown in the above-mentioned embodiments, the sampling frequency component cannot be reproduced substantially. Even if such sampling frequency component is reproduced with a very small sound pressure, listeners can hardly hear such sounds exceeding 20 kHz, which therefore does not cause any trouble when the listeners listen to a piece of music.

Then, according to the above-mentioned embodiments, it is possible to realize a speaker of small distortion and large maximum output in which sounds can be directly reproduced by the digital audio signal without using a D/A (digital-to-analog) converter and a power amplifier.

Incidentally, while the drive coils are driven by the digital audio signal as described above, if the drive coils corresponding to the bits of small drive current are relatively made of thin wire material and the drive coils corresponding to the bits of large drive current are relatively made of a thick wire material, then the drive coils can be efficiently driven with a small distortion.

While the embodiments in which the present invention is applied to the electromagnetic induction type speaker have been described so far, the present invention is not limited thereto, and may be applied to a headphone. Furthermore, if the input/output relationship is reversed, then the present invention may be applied to a microphone.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. An electromagnetic induction type acoustic transducer having an annular plate, a pole piece, a drive coil, and a non-magnetic diaphragm, the apparatus comprising:

a magnetic gap formed between an inner diameter of said annular plate and said pole piece forming a magnetic circuit;

a secondary coil formed of non-magnetic conductive material attached to said diaphragm interposed in said magnetic gap for vibratory movement in said magnetic gap, said diaphragm generating sounds upon being vibrated; and an annular drive coil housing portion disposed in one of said plate and said pole piece at a position opposing said magnetic gap and said drive coil being housed in said annular coil housing portion, wherein a dimension of said drive coil is increased in a direction perpendicular to a vibrating direction of said diaphragm, so that said drive coil is formed as an annular flat winding having a diametric width greater than a longitudinal thickness.

2. An electromagnetic induction type acoustic transducer apparatus as claimed in claim 1, wherein said coil housing portion is a large ring-like groove extended from the vibration direction of said diaphragm to the direction perpendicular to the vibration direction of said diaphragm.

3. An electromagnetic induction type acoustic transducer apparatus as claimed in claim 1, wherein said coil housing portion divides said plate or said pole piece forming said magnetic gap in the vibration direction of said diaphragm and is formed between divided plates or pole pieces.

4. The electromagnetic induction type acoustic transducer apparatus as claimed in claim 1, wherein said drive coil is comprised of a plurality of drive coils, and said plurality of drive coils are connected in one of series and parallel relative to each other.

5. The electromagnetic induction type acoustic transducer apparatus as claimed in claim 4, wherein said plurality of drive coils are adapted to be driven by a digital signal connected directly to said plurality of drive coils.

* * * * *